United States Patent [19]

Kauss

[11] Patent Number: 4,960,035

[45] Date of Patent: Oct. 2, 1990

[54] CONTROL SYSTEM FOR A HYDRAULIC LIFT DRIVEN BY A VARIABLE DISPLACEMENT PUMP

[75] Inventor: Wolfgang Kauss, Lohr-Wombach, Fed. Rep. of Germany

[73] Assignee: Mannesmann Rexroth GmbH, Lohr am Main, Fed. Rep. of Germany

[21] Appl. No.: 247,863

[22] Filed: Sep. 22, 1988

[30] Foreign Application Priority Data

Oct. 5, 1987 [DE] Fed. Rep. of Germany ..... 3733679

[51] Int. Cl.[5] ..... F15B 11/08

[52] U.S. Cl. ..... 91/445; 91/447; 91/461

[58] Field of Search ..... 91/447, 445, 461

[56] References Cited

U.S. PATENT DOCUMENTS

| | | | |
|---|---|---|---|
| 3,096,690 | 5/1960 | Hayner | 91/461 |
| 3,906,840 | 9/1975 | Bianchetta et al. | 91/445 |
| 4,111,283 | 9/1978 | Hastings | 91/447 |
| 4,283,996 | 8/1981 | Jackson | 91/447 |
| 4,353,289 | 10/1982 | Lonnemo | 91/461 |
| 4,379,389 | 4/1983 | Liesener | 60/428 |
| 4,425,759 | 1/1984 | Krusche | 60/420 |
| 4,523,430 | 6/1985 | Masuda | 60/420 |
| 4,542,678 | 9/1985 | Kochendorfer et al. | 91/445 X |
| 4,642,984 | 2/1987 | Dixen | 60/427 |
| 4,697,498 | 10/1987 | Yoshikawa et al. | 91/447 X |
| 4,712,377 | 12/1987 | Yoshida et al. | 60/444 |

FOREIGN PATENT DOCUMENTS

| | | |
|---|---|---|
| 1027828 | 3/1978 | Canada . |
| 0167818 | 1/1986 | European Pat. Off. . |
| 59-40002 | 3/1984 | Japan . |
| 1361769 | 7/1974 | United Kingdom . |
| 1543408 | 4/1979 | United Kingdom . |
| 2040402 | 8/1980 | United Kingdom . |

*Primary Examiner*—Edward K. Look
*Assistant Examiner*—John E. Ryznic
*Attorney, Agent, or Firm*—Burns, Doane, Swecker & Mathis

[57] ABSTRACT

A control system for a hydraulic lift driven by a variable displacement pump is disclosed. It is comprised of a blocking valve which may be opened at least for lowering movement of the hydraulic lift. A control device is provided for opening and closing the blocking valve and for regulating the volumetric flow from a pump line to an operating line leading to the hydraulic lift, and the flow from the hydraulic lift to a tank line leading to a tank. In addition, a load indicating line is provided which transmits the load pressure. The control device is comprised of a servo valve with three valve positions, and is further comprised of an actuator unit which opens and closes the blocking valve. The servo valve regulates the volumetric flow to and from the hydraulic lift. The load registering line is connected to the operating line, and in the initial position of the control device the load registering line is connected via the servo valve to the tank. The middle position (blocking position) of the servo valve is next to the initial position of said servo valve, and in turn a third valve position is next to the blocking position [of said valve] and serves to connect the operating line to the pump.

6 Claims, 1 Drawing Sheet

CONTROL SYSTEM FOR A HYDRAULIC LIFT DRIVEN BY A VARIABLE DISPLACEMENT PUMP

FIELD AND BACKGROUND OF THE INVENTION

The invention relates to a control system for a hydraulic lift driven by a variable displacement pump.

In a type of control system customarily used in applications of this nature, control means are provided which system in one of its control configurations controls a blocking valve or blocking device disposed in the consuming device line leading to the power lift, in another of its control configurations controls a hydraulic unit which switches the variable displacement pump feeding the hydraulic system to various operating states, in yet another of its control configurations regulates (via variable opening areas) a pumped flow between a pump line and the consuming device line leading to the power lift, and in still another of its control configurations regulates (via variable opening areas) a tank flow between the consuming device line and a tank line leading to a reservoir.

A control system of this customary type was necessary for a hydraulic system supplied by a constant pump because in such hydraulic systems the constant pump is shut off when the servo valve is in the neutral position, and the blocking device must be closed in order to avoid substantial power losses. This control system is also used for hydraulic systems which employ variable displacement pumps in order to reduce power losses. Such pumps are increasingly employed for this power conservation reason.

The constraint requiring the combining of switching functions and volumetric flow regulation functions by the servo valve results in disadvantages, in as much as the dynamics and accuracy of the control system are thereby limited. Inevitably the response quality of the control suffers, because in the connection to the consuming device (namely, in the consuming device line leading to the power lift) a pressure increase from a low value in the line can be accomplished only gradually.

OBJECT AND SUMMARY OF THE INVENTION

The underlying object of the invention is to provide an improved control system for a hydraulic lift driven by a variable displacement pump (controlling pump), which system has a simpler structure and is easier to manufacture than the conventional control systems and also provides improved response characteristics for the hydraulic lift.

According to the invention a control device enables the switching functions of the control system to be conducted separately from the volumetric flow regulation functions. The control system of the invention therefore opens the possibility of reacting individually to various operating requirements encountered in operating a hydraulic lift fed by a variable displacement pump. If accuracy and speed of reaction are called for by a given situation, the variable displacement pump is operated in a load-sensing mode, and the blocking device is held open. In operating phases with less stringent requirements (e.g. those prevailing when a vehicle equipped with the hydraulic lift under load is driven from one place to another), the variable displacement pump can be switched to a stand-by mode by connecting a load-registering line to a tank, and automatically closing the blocking device to thereby secure the load. Because the variable displacement pump is always set to the load pressure before the blocking device is opened, even at a high load pressure, it is unnecessary to precontrol the blocking device. That is, the engineering design of the blocking device may be much less costly, and in addition various hydraulic control lines and control elements present in a customary control system are no longer needed. The combination of the load-sensing operation with the actuation of a blocking device not burdened with a precontrol arrangement provides reliable operation for controlled hydraulic systems working with a high load. Because the control pressure is low compared to the load pressure, a heavy load always can be lowered directly from the "neutral" position of the servo valve. This also eliminates the possibility of a sudden and rapid lowering of a heavy load upon startup, even if for some reason (or by mistake) the servo valve is in its lowering position.

With the present invention it is possible to carry out volumetric flow regulation by the servo valve, and the switching functions which bring about opening of the blocking valve (or other blocking device), with the aid of a single control pressure system or source. A part of the control range of the control pressure is reserved for the switching function, and the control area of the servo element of the blocking-valve-actuating piston is greater than the control area of the servo component of the servo valve.

In one embodiment of the invention, the control pistons of the servo valve and the blocking-valve-actuating piston are in mutual mechanical contact as long as the control pressure is below the selected "switching pressure" value. The blocking device is closed. The servo valve, by means of its spring and that of the actuator unit, is in a position in which the load registering line and the consuming device line to the hydraulic lift are connected to a tank. Thus, the load registering line is substantially depressurized, so that the variable displacement pump is operating in stand-by mode. When the control pressure is increased to the "switching pressure" value, the control piston of the servo valve and the actuating piston of the blocking device move apart. If the control pressure is raised further, as soon as it reaches the "neutral pressure" valve it holds the servo valve in a blocking position, against the force of the spring of said valve. In the blocking position of the servo valve, the servo valve blocks the connection between the load registering line and the tank, so that the variable displacement pump is put into the load-sensing mode, and the blocking device remains open. To lower the hydraulic lift, the control pressure is raised above a "neutral pressure" value, so that the servo valve is moved out of the blocking position and into the lowering position, by its servo component, against the force of the spring. In the lowering position, the consuming device line (to the hydraulic lift) is connected to the tank, and thus is depressurized. To raise the hydraulic lift, the control pressure is reduced below the "neutral pressure", so that the servo valve is moved out of the blocking position and into the lifting position, by the spring. In the lifting position, the consuming device line to the hydraulic lift is connected to the pump line, and is thereby pressurized. Because the servo element of the blocking valve actuating piston has a larger effective surface than the servo component of the servo valve, the parameters of the springs can be suitably chosen so that only a small part of the control range of the control pressure is required for the switching functions. A check valve is provided in the pump line, which reliably prevents backflow of hydraulic fluid from the consuming device line to the pump line when there is a heavy load.

BRIEF DESCRIPTION OF THE DRAWING

The invention will be described in more detail below, with the aid of exemplary embodiments and with reference to the drawings, in which.

DETAILED DESCRIPTION OF PREFERRED EMBODIMENTS

Figure 1:
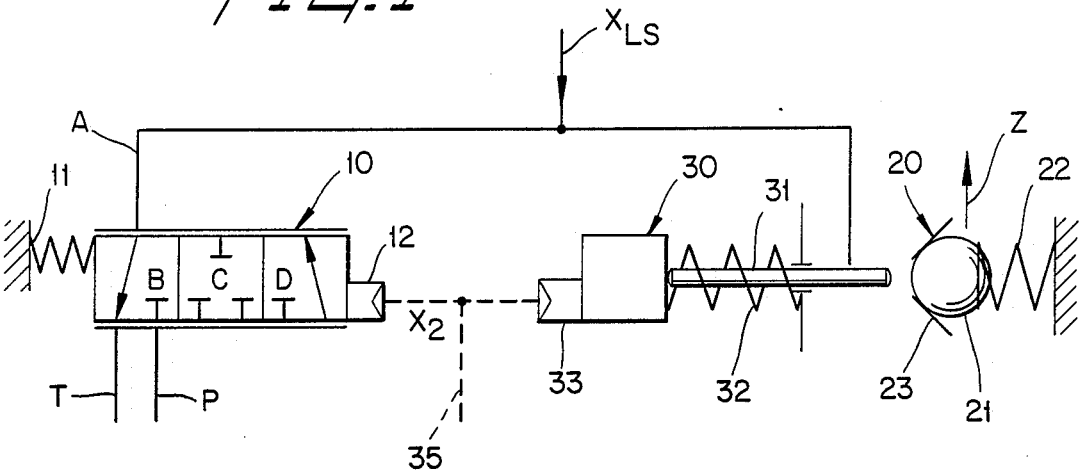
FIG. 1 shows an embodiment of a control system according to the invention.

The control system illustrated in FIG. 1 controls a consuming device line Z leading to a hydraulic lift (not shown). The control system comprises a 3/3-way servo valve 10 which has connections to a pump line P connected to the output of a variable displacement pump, a tank line T leading to a tank, and an operating line A leading to the consuming device line Z via a blocking device 20.

A load indicating or registering line $X_{LS}$ is connected to the operating line A. In the initial position of the servo valve 10, the line $X_{LS}$ is depressurized into the tank via the control path A-T. As soon as a pressure buildup occurs in line $X_{LS}$, a registration signal is transmitted from said line to a control block (not shown) for the variable displacement pump. When the registration signal is present, i.e., when the load registration pressure exceeds a certain threshold value, the variable displacement pump is operated in the load sensing mode, and when a registration signal does not exist, i.e., when the load registration pressure is lower than the certain threshold value, the variable displacement pump is operated in the stand-by mode.

The servo valve 10 is continuously urged into its initial control position B by a spring 11, and can be moved into its other control positions by application of control pressure to a servo component 12 which operates against the spring force.

The blocking device 20 is disposed between the operating line A and the consuming device line Z. It has a valve element 21 which is pressed by a spring 22 against a valve seat 23, to block passage of fluid between the operating line A and the consuming device line Z.

An actuator unit 30 serves to open the blocking device 20. It is comprised of an actuating rod 31 which is continuously urged into and held in a position distant from the valve element 21 by a spring 32. On the side of the actuator unit 30 opposite to the side on which the spring 32 is disposed, a servo element 33 is provided. When element 33 is pressurized, the actuator unit can be moved against the force of the spring 32, thereby moving the actuating rod 31 to unblock the blocking device 20.

Both of the servo components (12, 33) are connected to a common control pressure line 35 and are subject to being acted on by the same control pressure, $X_2$. The control surface of the servo component 12 of the 3/3-way servo valve 10 is smaller than that of the servo element 33 of the actuator unit 30.

In its initial position B, the 3/3-way servo valve 10 opens the operating line A (which is cut off from the consuming device line Z by the blocking device 20), thereby connecting the load registering line $X_{LS}$ to the tank line T. The load registering line $X_{LS}$ is depressurized, and the control block of the variable displacement pump does not receive a registration signal. Therefore the variable displacement pump operates in a stand-by mode. The initial position B of the 3/3-way servo valve 10 and the closed position of the blocking device 20 are maintained by the springs 11 and 32, respectively, as long as the control pressure line 35 is unpressurized.

As soon as a control pressure $X_2$ is established in the control line 35, the pressure is applied to the servo element 33 of the actuator unit 30 and the servo component 12 of the 3/3-way servo valve 10. Because the control surface area of the servo element 33 of the actuator unit 30 is greater than the corresponding area of the servo component 12 of the 3/3-way servo valve 10, the actuator unit 30 is first moved against the force of the spring 32, whereby the blocking device 20 is opened.

The control pressure $X_2$ increases further very rapidly, i.e., by pilot pressure control valve (not shown), until it reaches a "neutral value", at which the 3/3-way servo valve 10 is held in its blocking position C in consequence of the action of the control pressure $X_2$ on its servo component 12 against the force of spring 11. In order to prevent the 3/3-way servo valve 10 from remaining in its initial position B for too long after the switching pressure level is exceeded at which the process of de-blocking the blocking device 20 is set into effect (prior to said pressure $X_2$ reaching the "neutral" level at which level the valve 10 assumes its blocking position C), the increase of the control pressure $X_2$ to the "neutral" level is carried out at high speed.

After the control pressure $X_2$ reaches the "neutral" level, the 3/3-way servo valve 10 can be returned (by means of spring 11) to its initial position B by a reduction of the control pressure $X_2$ to a value below the "neutral" level (with the lower limit of this reduction being given by the "switching pressure" level). This position B is the lowering position when the blocking device 20 is open. In this position valve 10 is used for volumetric flow regulation of flow from the consuming device line Z to the tank line T as a function of the control pressure $X_2$.

When the control pressure $X_2$ is increased to levels above the "neutral value", the 3/3-way servo valve 10 can be moved (by means of the control pressure $X_2$ acting on the servo component 12 and overcoming the force of the spring 11) into its operating position D, the lifting position, in which position valve 10 is used for volumetric flow regulation of flow from the pump line P to the consuming device line Z.

With this control device, a part of the control pressure range is reserved for actuating the actuator unit which opens the blocking device 20; at these reserved pressures the 3/3-way servo valve 10 does not have available a mode in which it regulates volumetric flow.

For example, if a total control pressure range of 0–20 bar is available for the control pressure $X_2$, by appropriate choice of the parameters of the springs 11 and 32 it is possible to fix the "switching pressure" value, at which the blocking device 20 is unblocked, at 5 bar, and the "neutral value" at which the 3/3-way servo valve 10 is held in its blocking position C, at 12.5 bar, whereby a control pressure region of 7.5 bar, namely between 5 bar and 12.5 bar pressure, is available for volumetric flow regulation in the lowering position B of the 3/3-way servo valve 10; and a second control pressure region of 7.5 bar, namely between 12.5 bar and 20 bar pressure, is available for volumetric flow regulation in the lifting position D of the servo valve 10.

Figure 2:
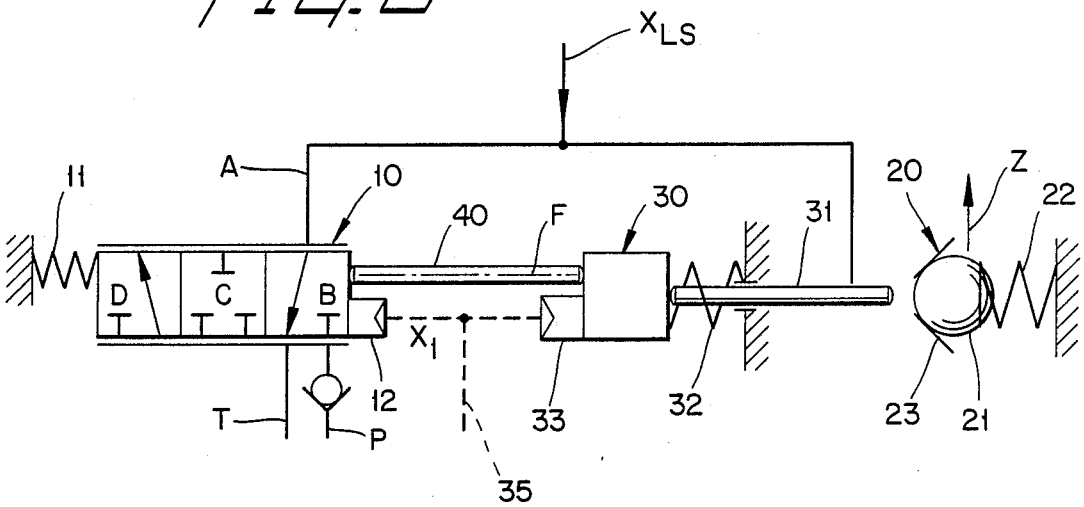
FIG. 2 shows a second embodiment of this system.

The embodiment of the control system illustrated in FIG. 2 differs from that of FIG. 1 in that the control piston (not shown) of the 3/3-way servo valve 10 and the control piston (also not shown) of the actuator unit 30 are disposed on a common sliding axis F, and a mechanical coupling member 40 is disposed between the mutually facing ends of these control pistons, which member 40 can be brought into engaging contact against the two said piston ends. The end of the 3/3-way servo valve piston which is directed away from the coupling member 40 is acted on by the spring 11 and the end of the actuator unit piston which is directed away from the coupling member 40 is acted on by the spring 32.

In the initial position of the control system, the 3/3-way servo valve 10 is in the lowering position B, as a result of the action of the spring 11 and that of spring 32 transmitted to valve 10 by the mechanical coupling member 40; i.e., the spring 32 of the actuator unit 30 is also utilized to fix the control piston of the 3/3-way servo valve 10 in the lowering position B of said valve 10.

The parameters of the two springs (11, 32) are chosen such that in the initial position of the control system, wherein the control pressure $X_1$ is at its minimal value, the initial position B of the 3/3-way servo valve 10 is that in which the operating line A is connected to the tank line T. If the control pressure is now increased, first the control piston of the actuator unit 30 is moved against the force of the spring 32, causing the blocking device 20 to open. At the same time, the force of spring 32, which was transmitted to the control piston of the 3/3-way servo valve 10 via the coupling member 40 in the initial position of the control system, is no longer active on the 3/3-way valve 10, so that now the force of the spring 11 of valve 10 prevails, causing the control piston of 3/3-way servo valve 10 to move in the direction which establishes the blocking position (middle position) C. The "neutral value" of the control pressure is sufficient to counterbalance the force of the spring 11 of the servo valve 10 such that valve 10 assumes its blocking position C wherein all connections to it are blocked off.

For volumetric flow regulation of hydraulic fluid flow to the hydraulic lift, the control pressure is slightly reduced (but not as far as the "switching value" which is the lower threshold for opening the blocking device 20) so as to establish a connection between the operating line A and the pump line P. For volumetric flow regulation of hydraulic fluid flow from the hydraulic lift into the tank, which requires a connection between the operating line A and the tank line T, the control pressure $X_1$ is increased above the "neutral value". If the control pressure $X_1$ is released suddenly, the 3/3-way servo valve 10 first slides briefly into the fully open lifting position D, until it is rapidly thereafter moved by the spring 32 of the actuator unit 30 back to the illustrated initial position B.

The control system disclosed is for a hydraulic lift driven by a variable displacement pump or the like. The system has a blocking valve which is openable at least for lowering movement of the hydraulic lift. The blocking valve is operated by a control device which also regulates the volumetric flow from a pump line to an operating line leading to the hydraulic lift, and the flow from the hydraulic lift to a tank line leading to a tank. In addition, a load registration line is provided which transmits the load pressure for instrumentation and control purposes. The control device has a servo valve with three positions, and an actuator unit which opens and closes the blocking valve. The servo valve regulates the volumetric flow to and from the hydraulic lift. The load registration line is connected to the operating line, and in the initial position of the control device the load registration line is connected, via the servo valve, to the tank. The initial position of the servo valve, wherein the operating line is connected to the tank line, is next to the middle position (blocking position) of said valve, which in turn is next to a position of said valve in which the operating line is connected to the pump line.

It will be understood that volumetric flow regulation occurs because the progressive movement of the servo valve spool away from its middle or blocking position (C in both of the illustrated embodiments) results in a progressive opening of the flow passage through the servo valve.

What is claimed is:

1. A control system for a hydraulic lift driven by a variable displacement pump or the like there being an operating line leading to the hydraulic lift, a pump line leading from the pump, and a tank line leading to a tank; said system comprising a blocking valve in the operating line which may be opened at least for lowering movement of the hydraulic lift, control means for opening and closing the blocking valve and for regulating the volumetric flow selectively from the pump line to the operating line leading to the hydraulic lift, or from the hydraulic lift to the tank line leading to the tank, and a load registration line connected to the operating line for transmitting load pressure to the pump; said control means including an actuator unit for opening and closing the blocking valve, and a servo valve for regulating the volumetric flow to and from the hydraulic lift, said servo valve being movable between a tank position, a valve position, and a neutral position and being biased toward said tank position; said tank position connecting the tank line to the operating line and to the load registration line, said valve position connecting the pump line to the operating line and to the load registration line; said neutral position being situated between said tank and valve positions; the operating line interconnecting said servo valve and said blocking valve in series, whereby fluid conducted through either of said servo valve and blocking valve passes through the other of said servo valve and blocking valve.

2. A control system according to claim 1, wherein the actuator unit and the servo valve are connected to a common control press line to be acted on by the same control pressure therein, and the actuator unit having a larger controls surface area upon which the control pressure can act than does the servo valve.

3. A control system according to claim 2, wherein control pistons of the servo valve and the actuator unit are disposed on a common sliding axis; and wherein the mutually facing control piston ends of the servo valve and the actuator unit, respectively, are operably interconnected by a mechanical non-positive coupling member such that the connection is maintained by external forces rather than by mechanical interlocking, and the outwardly directed ends of said control pistons are acted on by respective springs which, as soon as the control pressure falls below a prescribed limiting value; cause the servo valve to move into its tank position, the mutually facing ends of the control pistons have servo components arranged to be acted on by said control pressure, with the control surface area of the servo component of the servo valve being smaller than the control surface area of the servo component of the actuator unit.

4. A control system according to claim 1, wherein control pistons of the servo valve and the actuator unit are disposed on a common sliding axis; and wherein the mutually facing control piston ends of the servo valve and the actuator unit, respectively, are operably interconnected by a mechanical non-positive coupling member such that the connection is maintained by external forces rather than by mechanical interlocking, and the outwardly directed ends of said control pistons are acted on by respective springs which, as soon as the control pressure falls below a prescribed limiting value, cause the servo valve to move into its tank position, the mutually facing ends of the control pistons have servo components arranged to be acted on by a common control pressure, with the control surface area of the servo component of the servo valve being smaller than the control surface area of the servo component of the actuator unit.

5. A control system for a hydraulic lift driven by a variable displacement pump or the like, said system comprising a blocking valve which may be opened at least for lowering movement of the hydraulic lift, control means for opening and closing the blocking valve and for regulating the volumetric flow either from a pump line to an operating line leading to the hydraulic lift or from the hydraulic lift to a tank line leading to a tank, and a load registration line which transmits the load pressure; said control means including an actuator unit for opening and closing the blocking valve, and a servo valve for regulating the volumetric flow to and from the hydraulic lift and having three valve positions such that in the initial position of the control means the load registering line is connected via the servo valve to the tank, and the middle position is a blocking position next to the initial position of said servo valve, and a valve position is next to said blocking position and connects the operating line to the pump line; said load registering line being connected to the operating line, the control pistons of the servo valve and the actuator unit are disposed on a common sliding axis; and wherein the mutually facing control piston ends of the servo valve and the actuator unit, respectively, are operably connected by a mechanical non-positive coupling member such that the connection is maintained by external forces rather than by mechanical interlocking, and the outwardly directed ends of said control pistons are acted on by respective springs which, as soon as the control pressure falls below a prescribed limiting value, cause the servo valve to move into its initial position, the mutually facing ends of the control pistons have servo components arranged to be acted on by the same control pressure, with the control surface area of the servo component of the servo valve being smaller than the control surface area of the servo component of the actuator unit.

6. A control system according to claim 5, wherein the actuator unit and the servo valve are acted on by the same control pressure, and the actuator unit has a larger control surface area upon which the control pressure can act than does the servo valve.

* * * * *